US011118345B2

(12) United States Patent
Gstach et al.

(10) Patent No.: US 11,118,345 B2
(45) Date of Patent: Sep. 14, 2021

(54) STRUCTURE HAVING EDGE REINFORCEMENT ON PROFILED RAIL

(71) Applicant: Hilti Aktiengesellschaft, Schaan (LI)

(72) Inventors: Peter Gstach, Bludesch (AT); Jakob Kunz, Grabs (CH); Andrin Nigg, Triesen (LI); Bernhard Winkler, Feldkirch (AT); Philipp Grosser, Buchs (CH); Daniele Casucci, Buchs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 16/631,128

(22) PCT Filed: Jul. 25, 2018

(86) PCT No.: PCT/EP2018/070160
§ 371 (c)(1),
(2) Date: Jan. 14, 2020

(87) PCT Pub. No.: WO2019/025254
PCT Pub. Date: Feb. 7, 2019

(65) Prior Publication Data

US 2020/0232206 A1 Jul. 23, 2020

(30) Foreign Application Priority Data

Aug. 1, 2017 (EP) ..... 17184149

(51) Int. Cl.
*E04B 1/41* (2006.01)
*E04C 5/01* (2006.01)

(52) U.S. Cl.
CPC ..... *E04B 1/4107* (2013.01); *E04C 5/01* (2013.01); *E04B 2001/4192* (2013.01)

(58) Field of Classification Search
CPC .. E04B 1/4107; E04B 1/41; E04B 2001/4192; E04G 21/185; E04G 15/061
See application file for complete search history.

(56) References Cited

U.S. PATENT DOCUMENTS 4,073,114 A 2/1978 Elwood
8,635,832 B2 1/2014 Heudorfer et al.
(Continued)

FOREIGN PATENT DOCUMENTS

CN 106049689 A 10/2016
DE 2026602 A1 12/1971
(Continued)

OTHER PUBLICATIONS

International Search Report of PCT/EP2018/070160, dated Sep. 25, 2018.
(Continued)

*Primary Examiner* — Babajide A Demuren
*Assistant Examiner* — Daniel J Kenny
(74) *Attorney, Agent, or Firm* — Davidson, Davidson & Kappel, LLC

(57) ABSTRACT

A structure is provided, including a concrete body having a first surface and having a second surface arranged at an angle to the first surface; a profiled rail embedded in the concrete body, the profiled rail having a rail body having a rail slot extending in the direction of the longitudinal axis of the profiled rail, and the profiled rail emerging on the first surface of the concrete body; and a reinforcing body, which emerges on the second surface of the concrete body and which overlaps with the rail body, with regard to the direction of the longitudinal axis of the profiled rail, at least in some regions. A profiled rail assembly for such a structure is also provided.

34 Claims, 2 Drawing Sheets

(56) References Cited

U.S. PATENT DOCUMENTS

| | | | | |
|---|---|---|---|---|
| 8,955,285 | B2 * | 2/2015 | Fournier | E04G 21/185 52/707 |
| 9,097,004 | B2 * | 8/2015 | Yau | E04C 5/166 |
| 9,394,681 | B2 | 7/2016 | Brunhuber et al. | |
| 9,840,838 | B2 | 12/2017 | Heudorfer et al. | |
| 9,938,709 | B2 | 4/2018 | Daudet | |
| 10,161,128 | B2 * | 12/2018 | Albartus | E21D 11/08 |
| 2011/0314764 | A1 † | 12/2011 | Basche | |
| 2014/0157718 | A1 | 6/2014 | Fournier et al. | |
| 2016/0305115 | A1 | 10/2016 | Albartua et al. | |
| 2016/0356045 | A1 | 12/2016 | Frenske et al. | |
| 2020/0173164 | A1 | 6/2020 | Gstach et al. | |

FOREIGN PATENT DOCUMENTS

| | | | |
|---|---|---|---|
| DE | 202015002648 | U1 | 12/2015 |
| EP | 2907932 | A1 | 8/2015 |
| EP | 3643847 | A1 | 4/2020 |
| GB | 2265640 | A | 10/1993 |
| GB | 2379226 | A | 3/2003 |
| KR | 20090043027 | A | 5/2009 |
| KR | 20090088106 | A | 8/2009 |
| WO | WO2009083002 | A | 7/2009 |
| WO | WO13013876 | A1 | 1/2013 |
| WO | WO2014044730 | | 3/2014 |
| WO | WO14058151 | A1 | 4/2014 |

OTHER PUBLICATIONS

Halfen, Anchors for Glazing, 16 pages, Feb. 1, 1999, Halfen.†
Halfen, Halfen Curtain Wall Support Systems, 1 page, Feb. 1, 2014, Halfen.†

* cited by examiner
† cited by third party

STRUCTURE HAVING EDGE REINFORCEMENT ON PROFILED RAIL

BACKGROUND

Anchor rails are known, for example from WO13013876 A1, which are cast into a concrete element such that a rail slot of the relevant anchor rail emerges. Hammer head elements can be anchored in the anchor rail and thus on the concrete body via this rail slot.

WO09083002 A1 discloses an anchor rail which is provided with additional transverse anchors. As a result, the load-bearing capacity of the anchor rail is intended to be improved, in particular in the edge region of a concrete element in the case of high transverse forces. A further anchor rail having transverse anchors is disclosed by EP2907932 A1 (WO14058151 A1).

SUMMARY OF THE INVENTION

It is an object of the present invention to provide, in a particularly simple and reliable manner, particularly high load values in profiled rails which are embedded in concrete bodies, in particular near edges, in particular in the case of transverse loads.

present invention provides a structure and a profiled rail.

A structure according to the invention has:

a concrete body having a first surface and a second surface arranged at an angle to the first surface, a profiled rail embedded in the concrete body, the profiled rail comprising a rail body having a rail slot extending in the direction of the longitudinal axis of the profiled rail, and the profiled rail emerging on the first surface of the concrete body, and a reinforcing body which emerges on the second surface of the concrete body and which overlaps the rail body, with regard to the direction of the longitudinal axis of the profiled rail, at least in part.

A first basic concept of the invention can be considered to be that of additionally reinforcing the concrete body near the edge. For this purpose, according to the invention a reinforcing body is arranged upstream of the rail body near the edge. This concept of the invention is based on the finding that when a profiled rail arranged near the edge is subjected to a transverse load, not the profiled rail itself, but also the surrounding concrete can be load-limiting, since the near-edge concrete may possibly break transversely to the edge if subjected to a transverse load transversely to the rail and the edge. The invention proceeds from here and provides, by means of the reinforcement body, an element which can counteract this process effectively, so that the load behavior can be improved in a simple manner. According to a further basic concept of the invention, the reinforcing body extends as far as the surface of the concrete body in front of the rail body and emerges on this surface. Rail bodies or reinforcing bodies therefore emerge on surfaces that are separated by the edge. This can achieve particularly efficient reinforcement with correspondingly good load values, inter alia because a particularly large distance can be reinforced. This embodiment also allows particularly easy positioning of the reinforcing body during the casting of the concrete body, as the contact surface of the reinforcing body which later emerges on the second surface can be easily fastened to the formwork element provided for casting the concrete body.

The second surface may in particular be arranged at a right angle to the first surface. In particular, the above-mentioned edge is formed between the first surface and the second surface. The longitudinal axis of the profiled rail expediently extends in parallel with this edge.

The profiled rail is expediently a C profiled rail. The rail slot is used for the insertion of hammer head elements, such as a hammer head bolt or a slot nut, into the rail body, where the hammer head element can then be secured by rotation about an axis extending perpendicularly to the rail slot in the profiled rail. The profiled rail emerges on the first surface, in particular in the region of the rail slot of the profiled rail. The longitudinal axis of the profiled rail can be understood in a manner conventional in the art to mean in particular the axis having the greatest extension.

In particular, it is possible that a head element of the reinforcing body described in more detail below emerges on the second surface of the concrete body, and that this head element of the reinforcing body overlaps the rail body, with regard to the direction of the longitudinal axis of the profiled rail. "Overlapping, when viewed from a position orthogonal to a plane" is defined herein as meaning to cover at least part of the same space along that orthogonal. The fact that the reinforcing body, in particular its head element, overlaps the profiled rail, with regard to the direction of the longitudinal axis of the profiled rail, can in particular have the result that the reinforcing body or its head element is arranged transversely upstream of the profiled rail at least in regions and/or that the reinforcing body or its head element is at least partially abeam of the profiled rail.

The reinforcing body and/or the head element is preferably made of a metal material, which may be advantageous in terms of the force absorption.

In particular, for further improvement of the load behavior it can be advantageously provided for the reinforcing body, in particular its head element, to overlap the rail body, with regard to the direction of the longitudinal axis of the profiled rail, over at least 50%, preferably at least 75%, of the length of the profiled rail measured in the direction of the longitudinal axis of the profiled rail. Accordingly, 50% or 75% of the length of the profiled rail is overlapped by the reinforcing body, in particular its head element.

It is particularly preferable for the reinforcing body, in particular its head element, to completely overlap the rail body, with regard to the direction of the longitudinal axis of the profiled rail. Accordingly, the reinforcing body or its head element is therefore at least as long as the profiled rail, particularly preferably longer than the profiled rail. As a result, the load behavior can be further improved.

As already explained above, the reinforcing body preferably has a head element, which, inter alia, may allow a particularly simple design.

Furthermore, it is advantageous that the reinforcing body has at least one tension element which protrudes from the head element, in particular towards the profiled rail. This makes it possible to achieve even more effective reinforcement. Preferably, a plurality of such tension elements is provided. The tension element is particularly suitable for receiving tensile loads and introducing tensile loads into the surrounding concrete. The tension element may for example be a round rod, with or without profiling, or a metal strip. The tension element can also be referred to as a reinforcing rod. The tension element is preferably made of metal. In particular, the at least one tension element is connected to the head element, for example welded thereto. The tension element can also be arranged longitudinally displaceably on the head element in order to be able to apply a pretension in the tension element. In order to hold the tension element in the pretensed state, a clamping nut can be screwed onto the tension element, which nut is supported on the head element.

It is particularly preferable for the at least one tension element to intersect the profiled rail, in particular when viewed perpendicularly to the first surface and/or when viewed perpendicularly to a slot plane spanned by the rail slot. The at least one tension element accordingly extends from the second surface behind the rail body, and therefore particularly good introduction of force into the concrete body can be provided.

The head element is expediently a head plate, preferably a flat cuboid, which may be advantageous in terms of the production outlay and the introduction of force.

Furthermore, it is expedient that the reinforcing body, in particular its head element, has at least one through-opening for a fastening pin, for example a nail, which allows particularly simple installation of the reinforcing body on the formwork element.

It is particularly preferable for the profiled rail to have anchors which are arranged on the rail body, i.e. for the profiled rail to be an anchor rail. The anchors are expediently arranged on the rail body on a rear face of the rail body that is remote from the rail slot. For a particularly compact design and particularly good force transmission, the at least one tension element expediently extends between the anchors and/or intersects the anchors when with regard to the direction of the longitudinal axis of the profiled rail.

The invention also relates to an element which is present prior to the casting of the concrete body, specifically a profiled rail assembly suitable for pouring into concrete, that has a profiled rail, the profiled rail comprising a rail body having a rail slot extending in the direction of the longitudinal axis of the profiled rail, and has a reinforcing body which overlaps the profiled rail, preferably on the head element of the reinforcing body, with regard to the direction of the longitudinal axis of the rail, at least in regions, and which has a contact surface for a formwork element.

By means of this contact surface, the reinforcing body can be easily positioned before casting the concrete body. After casting, the contact surface of the reinforcing body can then protrude on a surface of the concrete body.

The contact surface for the formwork element preferably extends at an angle, in particular at a right angle, to a slot plane spanned by the rail slot, which is advantageous in terms of the structural design and force transmission in near-edge applications.

In another preferred embodiment of the invention, the reinforcing body is already connected to the profiled rail before casting into concrete, i.e. outside the concrete. As a result, the profiled rail assembly can be installed in a particularly simple and reliable manner. The connection of the reinforcing body to the profiled rail can be provided in particular at least one tension element of the reinforcing body. The reinforcing body and the profiled rail can be welded, for example. However, the reinforcing body can also be separated from the profiled rail, i.e. is loose.

Preferably, the reinforcing body has at least one through-opening for a fastening pin, for example a nail, for fastening the reinforcing body to the formwork element, which can simplify installation even further. In particular, it is possible for the through-opening to extend from the contact surface.

Features which are explained in connection with the structure according to the invention can also be used in the profiled rail assembly according to the invention, and, conversely, features which are explained in connection with the profiled rail assembly according to the invention can also be used in the structure according to the invention.

BRIEF DESCRIPTION OF THE DRAWINGS

The invention is explained in greater detail in the following with reference to preferred embodiments, which are shown schematically in the accompanying drawings, it being possible to implement individual features of the embodiments shown in the following in principle individually or in any desired combination within the context of the invention. In the drawings, shown schematically.

DETAILED DESCRIPTION

Figure 1:
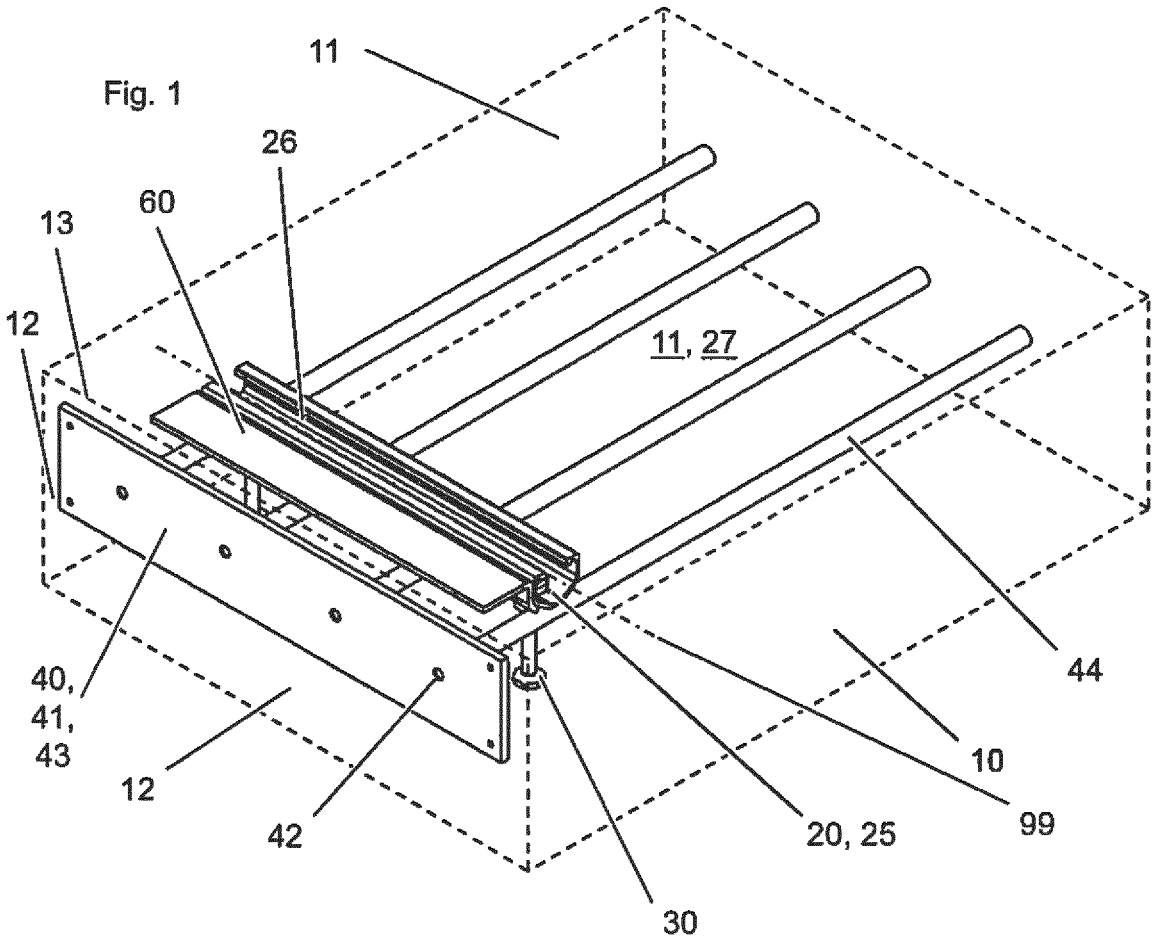
FIG. 1 is a perspective view of a structure according to the invention comprising a concrete body and a profiled rail assembly according to the invention, the concrete body being shown as transparent.

A first embodiment of a structure according to the invention comprising a profiled rail assembly according to the invention is shown in FIG. 1. The body structure comprises a concrete body 10 having a first surface 11 (the upper face in FIG. 1) and a second surface 12 (the left side face in FIG. 1), the second surface 12 extending perpendicularly to the first surface 11 in this case. An edge 13 is formed at the transition between the first surface 11 and the second surface 12.

The structure further comprises a profiled rail assembly, which in turn has a profiled rail 20 designed as an anchor rail and a reinforcing body 40. The profiled rail 20 has a C-shaped rail body 25 with a rail slot 26 which extends in the direction of the longitudinal axis 99 of the profiled rail 20, i.e. the long extension extends in parallel with the longitudinal axis 99 of the profiled rail 20. The rail body 25 is undercut at the rail slot 26. An elongate hammer head element can therefore be inserted into the rail body 25 through the rail slot 26 and fixed to the rail body 25 by rotation about an axis extending perpendicularly to the longitudinal axis 99 of the profiled rail 20. The profiled rail 20 also comprises a plurality (in this case two, by way of example) of anchors 30 which protrude from the rail body 25 on a rear face of the rail body 25 opposite the rail slot 26.

The profiled rail 20 is embedded in the concrete body 10, specifically in such a way that the profiled rail 20 emerges, with its rail slot 26, on the first surface 11 of the concrete body 10. The longitudinal axis 99 of the profiled rail 20 preferably extends in parallel with the above-mentioned edge 13 of the concrete body 10.

The reinforcing body 40 has a planar head element 41 and a plurality of elongate, preferably rod-shaped tension elements 44, which protrude from the rear face of the head element 41. The reinforcing body 40 emerges, with its head element 41, on the second surface 12 of the concrete body 10, specifically with a front-face contact surface 43. At this contact surface 43, the head element 41 comes into contact with a formwork element for the concrete body 10 before the casting of the concrete body 10. By means of fasteners (not shown), such as nails, which are passed through through-openings 42 in the head element 41, the head element 41 is fixed in this position on the formwork element.

The head element 41 of the reinforcing body 40 has, with regard to the direction of the longitudinal axis 99, a greater length than the profiled rail 20, the reinforcing body 40 completely covering the rail body 25, with regard to the direction of the longitudinal axis 99 of the profiled rail 20, i.e. the opposite ends of the profiled rail 20 are within or at least on the ends of the head element 41, with regard to the direction of the longitudinal axis 99 of the profiled rail 20.

The reinforcing body 40 is arranged so that the contact surface 43 of its head element 41 extends in parallel with the second surface 12 of the concrete body 10, perpendicularly to the first surface 11 of the concrete body 10 and/or perpendicularly to a slot plane 27 spanned by the rail slot 26 and extending in the first surface 11. When viewed perpendicularly to the longitudinal axis 99, i.e. in the viewing direction implemented in FIG. 2, the tension elements 44 extend between the anchors 30 and intersect the anchors 30.

The reinforcing body 40 reinforces the concrete body 10 in the region of the edge 13 and can in particular counteract premature breakage of the concrete body 10 in the case of transverse loads in the profiled rail 20, in particular in the case of loads directed toward the second surface 12 perpendicularly to the longitudinal axis 99.

To further improve the transverse load absorption, the profiled rail 20 may optionally have a stiffening element 60 which is angled, for example, and which stiffens the side wall of the rail body 25 nearer the edge 13.

Figure 2:
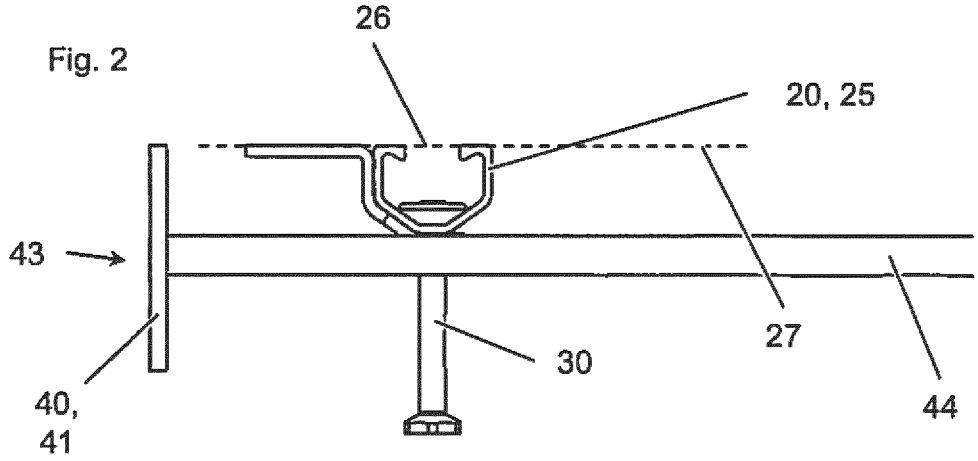
FIG. 2 is a side view of the profiled rail assembly from FIG. 1 prior to casting of the concrete body.

FIG. 2 shows the profiled rail assembly with the profiled rail 20 and the reinforcing body 40 before casting into the concrete body 10. As FIG. 2 shows, before casting, the reinforcing body 40 and the profiled rail 20 are already in the same arrangement relative to one another which is also maintained after casting. In order that the reinforcing body 40 and profiled rail 20 reliably remain in this arrangement during installation of the profiled rail assembly, the reinforcing body 40 is preferably already fixed to the profiled rail 20 before casting the profiled rail assembly. In the present embodiment, this fastening is implemented on the tension elements 44, which are fastened, for example, to the anchors 30 or the rail body 25, in particular to the rear face of the rail body 25, for example are welded thereto.

Figure 3:
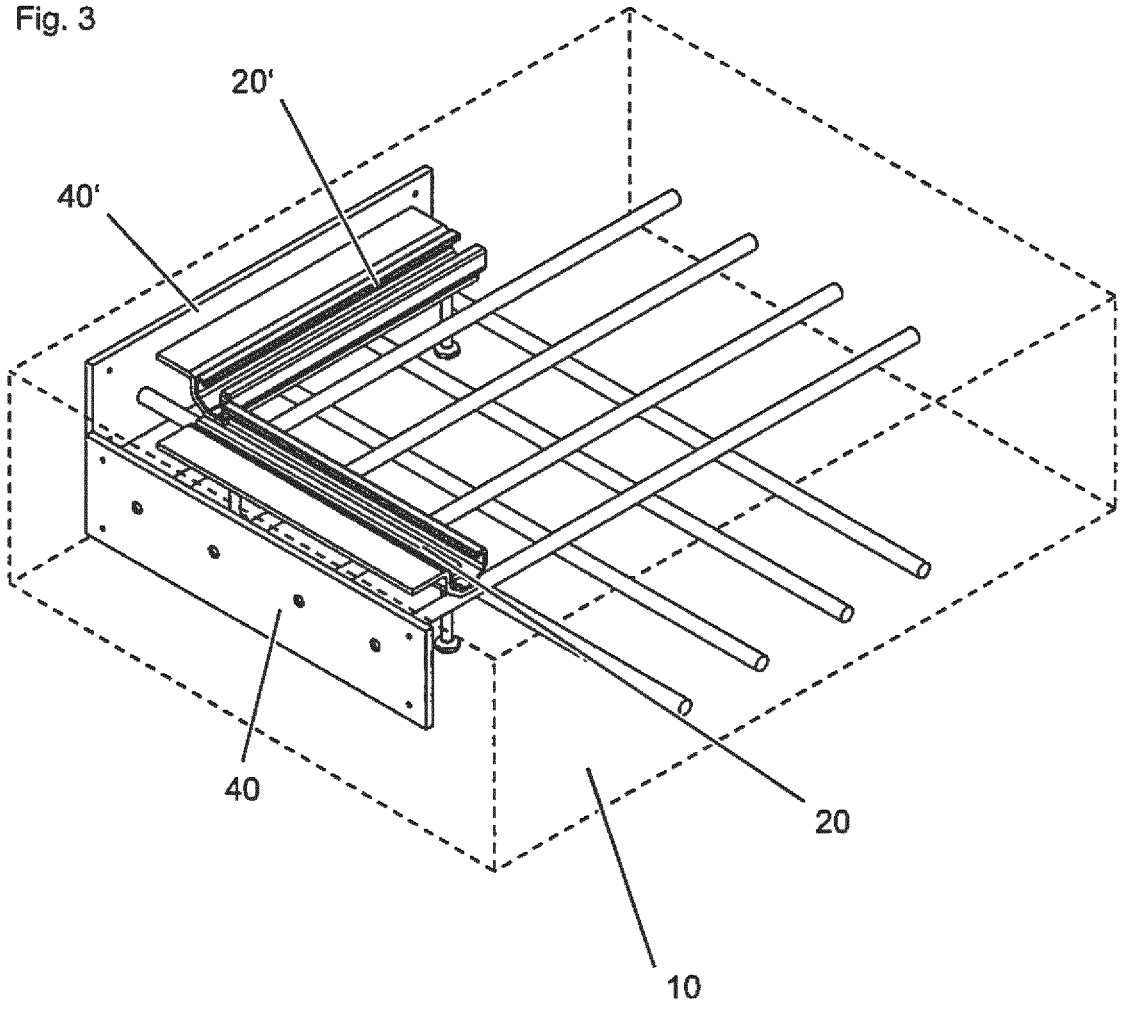
FIG. 3 is a perspective view similar to FIG. 1 of a modified embodiment of a structure according to the invention comprising a concrete body and comprising two profiled rail assemblies according to the invention arranged at angles.

FIG. 3 shows a modification of the structure of FIG. 1 close to the corner. In the embodiment of FIG. 3, in addition to the profiled rail assembly described above, a second profiled rail assembly having a second profiled rail 20' and a second reinforcing body 40' is provided, the two profiled rail assemblies being arranged on the concrete body 10 at 90° relative to one another. The longitudinal axes of the two profiled rails 20 and 20' are perpendicular to one another and the two reinforcing bodies 40 and 40' emerge on different surfaces.

The invention claimed is:

1. A structure comprising:

a concrete body having a first surface and a second surface arranged at an angle to the first surface;

a profiled rail embedded in the concrete body, the profiled rail including a rail body having a rail slot extending in the direction of a longitudinal axis of the profiled rail, the profiled rail emerging on the first surface of the concrete body; and a reinforcing body emerging on the second surface of the concrete body;

wherein the reinforcing body includes a head element and at least one tension element protruding from the head element, the head element emerging on the second surface to define a head element major face;

the head element overlapping the rail body, when viewed from a position orthogonal to the head element major face.

2. The structure as recited in claim 1 wherein the reinforcing body completely covers the rail body, with respect to the direction of the longitudinal axis of the profiled rail.

3. The structure as recited in claim 1 wherein the at least one tension element intersects the profiled rail.

4. The structure as recited in claim 1 wherein the head element is a head plate, or the head element has at least one through-opening for a fastening pin.

5. The structure as recited in claim 1 wherein the profiled rail includes anchors arranged on the rail body.

6. The structure as recited in claim 1 wherein the head element major face is planar.

7. The structure as recited in claim 6 wherein the at least one tension element includes a plurality of tension elements extending perpendicularly with respect to the contact surface.

8. The structure as recited in claim 1 wherein the rail slot emerges on the first surface and the profiled rail has a plurality of anchors protruding from the rail body on a rear face of the rail body opposite the rail slot.

9. The structure as recited in claim 8 wherein when viewed perpendicularly to the longitudinal axis, the at least one tension element intersects the anchors.

10. The structure as recited in claim 9 wherein the at least one tension element includes a plurality of tension elements.

11. The structure as recited in claim 8 wherein the plurality of anchors includes two anchors spaced apart in the direction of the longitudinal axis to define an anchor spacing.

12. The structure as recited in claim 11 wherein a first tension element of the at least one tension element passes through the anchor spacing.

13. The structure as recited in claim 12 wherein the at least one tension element including a second tension element passing through the anchor spacing and at least one third tension element not passing through the anchor spacing.

14. The structure as recited in claim 1 wherein the profiled rail includes a stiffening element attached to the rail body.

15. The structure as recited in claim 14 wherein the stiffening element emerges on the first surface between the rail body and an edge formed by the first and second surfaces.

16. The structure as recited in claim 1 wherein the concrete body has a third surface forming a corner with the first and second surfaces and further comprising a second profiled rail emerging from the first surface extending perpendicular to the direction of the longitudinal axis, and further comprising a second reinforcing body including a second head element emerging on the third surface and at least one second tension element protruding from the second head element.

17. The structure as recited in claim 1 wherein the head element completely overlaps the rail body, when viewed from the position orthogonal to the head element major face.

18. The structure as recited in claim 1 wherein the rail body has two ends in the direction of the longitudinal axis, the head element overlaps the rail body to extend past at least one of the two ends, when viewed from the position orthogonal to the head element major face.

19. The structure as recited in claim 1 wherein the rail body has two ends in the direction of the longitudinal axis, the head element overlaps the rail body to extend past both of the two ends, when viewed from the position orthogonal to the head element major face.

20. The structure as recited in claim 1 wherein the at least one tension element is fixedly connected to the reinforcing body.

21. A profiled rail assembly for casting into concrete, the profiled rail assembly comprising:

a profiled rail including a rail body having a rail slot extending in the direction of a longitudinal axis of the profiled rail, and a reinforcing body having a contact surface for a formwork element;

wherein the reinforcing body includes a head element and at least one tension element protruding from the head element, the head element opposite the at least one tension element having a head element major face defining the contact surface for the formwork element;

the head element overlapping the rail body, when viewed from a position orthogonal to the head element major face.

22. The profiled rail assembly as recited in claim 21 wherein the contact surface for the formwork element extends at an angle to a slot plane spanned by the rail slot.

23. The profiled rail assembly as recited in claim 21 wherein the reinforcing body is connected to the profiled rail.

24. The profiled rail assembly as recited in claim 21 wherein the reinforcing body has at least one through-opening for a fastening pin for fastening the reinforcing body to the formwork element.

25. The profiled rail assembly as recited in claim 21 wherein the head element completely overlaps the rail body, when viewed from the position orthogonal to the head element major face.

26. The profiled rail assembly as recited in claim 21 wherein the rail body has two ends in the direction of the longitudinal axis, the head element overlaps the rail body to extend past at least one of the two ends, when viewed from the position orthogonal to the head element major face.

27. The profiled rail assembly as recited in claim 21 wherein the rail body has two ends in the direction of the longitudinal axis, the head element overlaps the rail body to extend past both of the two ends, when viewed from the position orthogonal to the head element major face.

28. The profiled rail assembly as recited in claim 21 wherein the at least one tension element is fixedly connected to the reinforcing body.

29. A structure comprising:

a concrete body having a first surface and a second surface arranged at an angle to the first surface;

a profiled rail embedded in the concrete body, the profiled rail including a rail body having a rail slot extending in the direction of a longitudinal axis of the profiled rail, the profiled rail emerging on the first surface of the concrete body; and a reinforcing body emerging on the second surface of the concrete body;

wherein the reinforcing body includes a head element and at least one tension element protruding from the head element, the head element emerging on the second surface;

the head element overlapping the rail body with respect to the longitudinal axis of the profiled rail;

wherein the rail slot emerges on the first surface and the profiled rail has a plurality of anchors protruding from the rail body on a rear face of the rail body opposite the rail slot; and wherein when viewed perpendicularly to the longitudinal axis, the at least one tension element intersects the anchors.

30. A structure comprising:

a concrete body having a first surface and a second surface arranged at an angle to the first surface;

a profiled rail embedded in the concrete body, the profiled rail including a rail body having a rail slot extending in the direction of a longitudinal axis of the profiled rail, the profiled rail emerging on the first surface of the concrete body; and a reinforcing body emerging on the second surface of the concrete body;

wherein the reinforcing body includes a head element and at least one tension element protruding from the head element, the head element emerging on the second surface;

the head element overlapping the rail body with respect to the longitudinal axis of the profiled rail;

wherein the rail slot emerges on the first surface and the profiled rail has a plurality of anchors protruding from the rail body on a rear face of the rail body opposite the rail slot;

wherein the plurality of anchors includes two anchors spaced apart in the direction of the longitudinal axis to define an anchor spacing; and wherein a first tension element of the at least one tension element passes through the anchor spacing.

31. The structure as recited in claim 30 wherein the at least one tension element including a second tension element passing through the anchor spacing and at least one third tension element not passing through the anchor spacing.

32. A structure comprising:

a concrete body having a first surface and a second surface arranged at an angle to the first surface;

a profiled rail embedded in the concrete body, the profiled rail including a rail body having a rail slot extending in the direction of a longitudinal axis of the profiled rail, the profiled rail emerging on the first surface of the concrete body; and a reinforcing body emerging on the second surface of the concrete body;

wherein the reinforcing body includes a head element and at least one tension element protruding from the head element, the head element emerging on the second surface;

the head element overlapping the rail body with respect to the longitudinal axis of the profiled rail;

wherein the profiled rail includes a stiffening element attached to the rail body; and wherein the stiffening element emerges on the first surface between the rail body and an edge formed by the first and second surfaces.

33. A structure comprising:

a concrete body having a first surface and a second surface arranged at an angle to the first surface;

a profiled rail embedded in the concrete body, the profiled rail including a rail body having a rail slot extending in the direction of a longitudinal axis of the profiled rail and having two ends in the direction of the longitudinal axis, the profiled rail emerging on the first surface of the concrete body; and a reinforcing body emerging on the second surface of the concrete body;

wherein the reinforcing body includes a head element and at least one tension element protruding from the head element, the head element emerging on the second surface to define a head element major face;

wherein the rail body at each of the two ends defines two parallel cross-sectional planes having the longitudinal axis orthogonal to the cross-sectional planes, at least part of the head element being between the two cross-sectional planes.

34. A profiled rail assembly for casting into concrete, the profiled rail assembly comprising:

a profiled rail including a rail body having a rail slot extending in the direction of a longitudinal axis of the profiled rail, and having two ends in the direction of the longitudinal axis; and a reinforcing body having a contact surface for a formwork element;

wherein the reinforcing body includes a head element and at least one tension element protruding from the head element, the head element opposite the at least one tension element having a head element major face defining the contact surface for the formwork element;

wherein the rail body at each of the two ends defines two parallel cross-sectional planes having the longitudinal axis orthogonal to the cross-sectional planes, at least part of the head element being between the two cross-sectional planes.

* * * * *